US008172088B2

(12) United States Patent
Vedsted et al.

(10) Patent No.: US 8,172,088 B2
(45) Date of Patent: May 8, 2012

(54) AIR SEPARATOR

(75) Inventors: Lars Vedsted, Vadum (DK); Søren Vedsted, Vadum (DK)

(73) Assignee: Laitram, L.L.C., Harahan, LA (US)

( * ) Notice: Subject to any disclaimer, the term of this patent is extended or adjusted under 35 U.S.C. 154(b) by 172 days.

(21) Appl. No.: 12/719,463

(22) Filed: Mar. 8, 2010

(65) Prior Publication Data

US 2011/0215031 A1 Sep. 8, 2011

(51) Int. Cl.
*B07B 4/00* (2006.01)

(52) U.S. Cl. ..... 209/154; 209/138; 209/147

(58) Field of Classification Search ..... 209/138, 209/139.1, 143, 147, 468, 470, 475, 154, 209/193
See application file for complete search history.

(56) References Cited

U.S. PATENT DOCUMENTS

| | | | | | |
|---|---|---|---|---|---|
| 1,530,277 | A | * | 3/1925 | Mettler, Sr. | 209/137 |
| 2,041,591 | A | * | 5/1936 | Brown et al. | 209/35 |
| 2,390,150 | A | | 12/1945 | Johnson et al. | |
| 2,512,422 | A | | 6/1950 | Fletcher et al. | |
| 3,417,961 | A | | 12/1968 | Shorrock | |
| 3,664,349 | A | * | 5/1972 | Quick | 460/99 |
| 3,779,377 | A | | 12/1973 | Phelps | |
| 3,804,250 | A | | 4/1974 | Dankesreiter | |
| 3,909,873 | A | * | 10/1975 | Minasov et al. | 15/309.2 |
| 4,095,534 | A | * | 6/1978 | Goidich | 110/263 |
| 4,253,940 | A | * | 3/1981 | Price | 209/3 |
| 4,737,270 | A | | 4/1988 | Phelps | |
| 4,792,393 | A | * | 12/1988 | Blasczyk et al. | 209/135 |
| 5,685,434 | A | * | 11/1997 | Ackerman | 209/135 |
| 5,957,297 | A | * | 9/1999 | Eramaja | 209/20 |
| 7,712,611 | B2 | * | 5/2010 | Longhurst et al. | 209/143 |

FOREIGN PATENT DOCUMENTS

| | | | |
|---|---|---|---|
| DE | 537751 | C | 11/1931 |
| DE | 610112 | C | 3/1935 |
| DE | 610924 | C | 3/1935 |
| DE | 969075 | C | 4/1958 |
| EP | 0036438 | A2 | 9/1981 |
| GB | 363147 | A | 12/1931 |

OTHER PUBLICATIONS

Laitram Machinery, "Model AS Air Separator," brochure, Dec. 2001, Laitram Machinery, Inc., Harahan, Louisiana, U.S.A.
Laitram Machinery, "Model AS-MAX Air Separator," brochure, Mar. 2004, Laitram Machinery, Inc., Harahan, Louisiana, U.S.A.
International Search Report and Written Opinion of the International Searching Authority, PCT/US2011/024592, mailed Jan. 30, 2012, European Patent Office, Rijswijk, NL.

* cited by examiner

*Primary Examiner* — Joseph C Rodriguez
(74) *Attorney, Agent, or Firm* — James T. Cronvich

(57) ABSTRACT

Apparatus and method for separating lightweight waste from product with cyclic pulses of air. An air separator includes a blower duct directing air upward through product conveyed on a foraminous conveyor. A pair of counter-rotating vanes in the blower duct cyclically open and close to establish a pulsating air flow in the center of the duct across the width of the conveyor. The pulsating air flow lifts lightweight waste from the product and blows it through a vertical duct above the conveyor to waste separation chambers for separation and disposal.

26 Claims, 5 Drawing Sheets

AIR SEPARATOR

BACKGROUND

The invention relates generally to separating waste material from product and more particularly to apparatus and methods for separating lightweight waste from heavier product with blasts of air.

Air separators are used in the processing of many raw materials to separate lightweight debris and other materials from a product. Some examples include winnowing chaff from grain, separating coal into fines, shelling nuts, and separating loose shell and appendages from peeled shrimp meats. In the shrimp-processing industry, for example, machine-peeled shrimp are conveyed on a foraminous conveyor belt from a peeler to a cooker or packaging station. Although most of the shells, heads, and other appendages that are removed in the peeler are also washed away, some bits adhere to the peeled shrimp meats. The shrimp meats are conveyed through an air separator, which blows air up from a blower duct through the meats on the conveyor to lift the lighter shell and appendage peelings from the shrimp meats. The air flow carries the waste peelings away in a waste conveyor duct above the conveyor to a waste separation chamber in which the waste materials settle and are collected for disposal.

Conventional air separators have blowers, or fans, that produce a constant air flow whose speed may be modulated or unmodulated. A rotating paddle, or vane, in the blower duct of some air separators is used to modulate the air speed to produce a pulsating air flow. The speed of the air varies between a minimum speed when the vane is closed to block the duct and a maximum speed when the vane is open. With air-flow modulation, smaller and less noisy blowers can be used to achieve higher maximum speeds than with a constant, unmodulated flow. The higher air speeds improve the separation of the peelings from the meats.

One of the problems with conventional air separators, especially those for use with wet and slimy product like shrimp, is that the waste peelings can stick to the walls of the waste conveyor duct, necessitating frequent cleaning to keep the duct clear for effective separation.

SUMMARY

One version of an air separator embodying features of the invention for separating lightweight waste from product comprises a first duct having an exit proximate the underside of a conveyor conveying product in a conveying direction and a pair of vanes spanning the first duct. The vanes counter-rotate back and forth on parallel axes between a closed position blocking air flow through the first duct and an open position forming between the vanes a centrally disposed gap across the first duct to direct a pulsating air flow centrally through the first duct and the conveyor to blow lightweight waste upward from the product.

Another version of an air separator embodying features of the invention comprises a blower assembly disposed below the carryway of a foraminous conveyor belt conveying product in a conveying direction. The blower assembly includes a blower and a blower duct directing air from the blower upward through the foraminous conveyor belt. Two vanes extend laterally across the width of the blower duct on laterally disposed axes of rotation perpendicular to the conveying direction. The blower assembly also includes means for cyclically rotating the vanes on the axes of rotation between a closed position blocking the blower duct and an open position directing air in the blower duct between the vanes to produce a pulsating air flow through the foraminous conveyor belt.

In another aspect of the invention, a method for separating lightweight waste from product conveyed on a foraminous conveyor belt comprises: (a) directing an air flow through a duct and the underside of a foraminous conveyor belt conveying product in a conveying direction; (b) confining the majority of the air flow to a central portion of the duct uniformly across the width of the foraminous conveyor belt; and (c) cyclically pulsing the air flow between a maximum speed and a minimum speed to blow lightweight waste upward away from the product conveyed on the foraminous conveyor belt.

BRIEF DESCRIPTION OF THE DRAWINGS

These features and aspects of the invention, as well as its advantages, are better understood by referring to the following description, appended claims, and accompanying drawings, in which:

DETAILED DESCRIPTION

Figure 1:
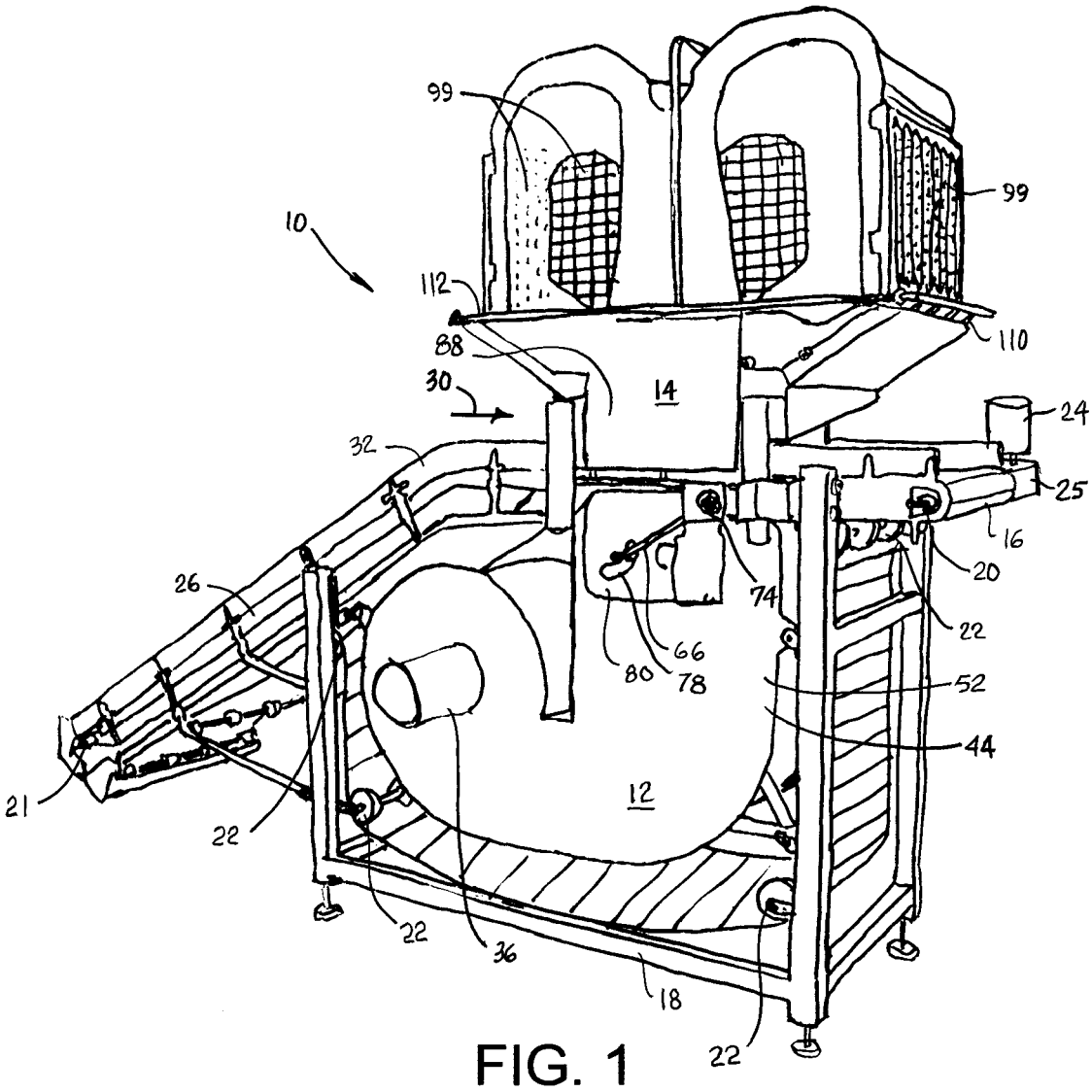
FIG. 1 is a perspective view of an air separator embodying features of the invention.
Figure 2:
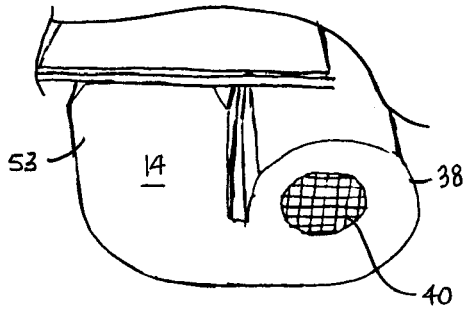
FIG. 2 is a perspective view of the blower assembly of the air separator viewed from the opposite side of FIG. 1.
Figure 3:
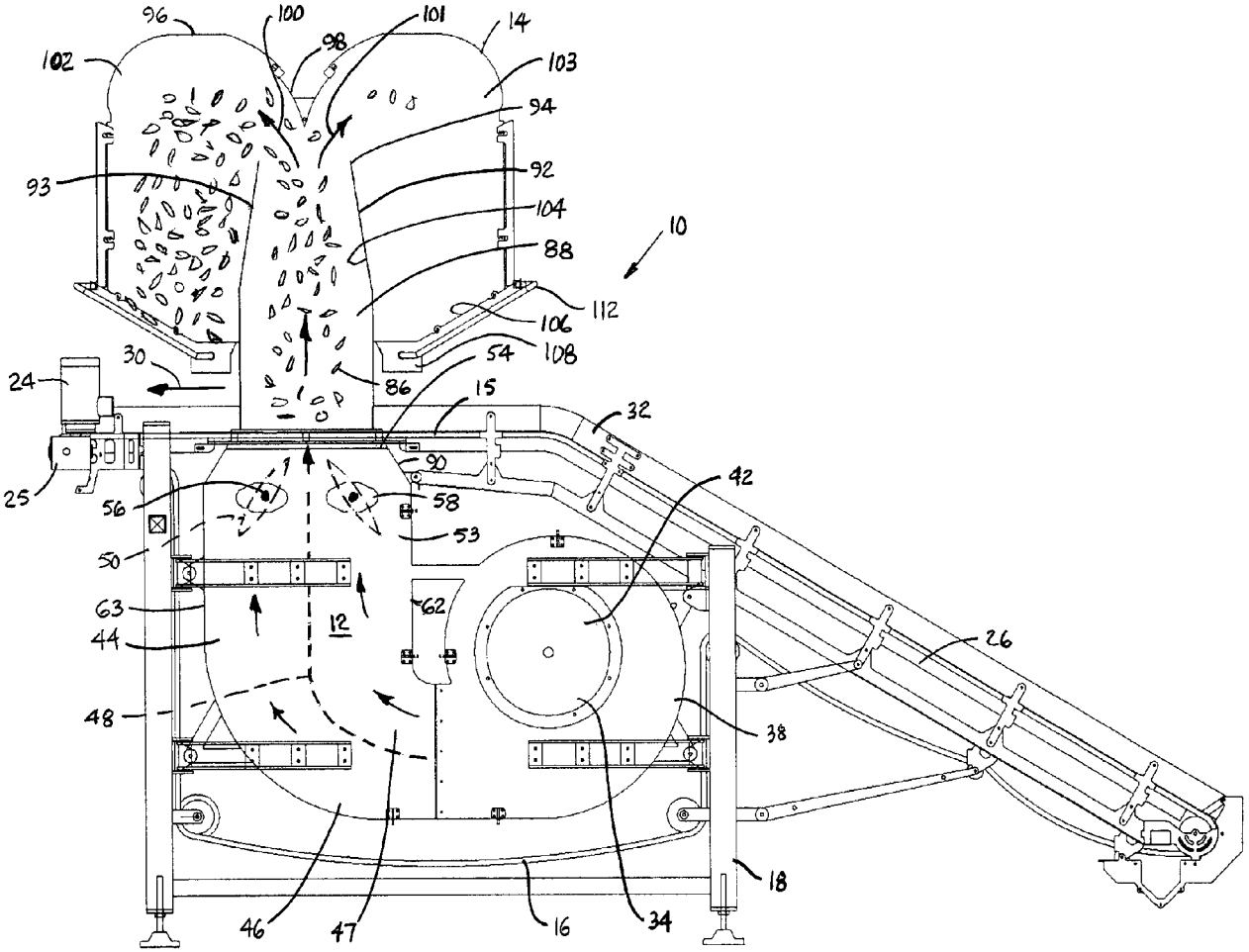
FIG. 3 is a side elevation view, partly cut away, of the air separator of FIG. 1.
Figure 4:
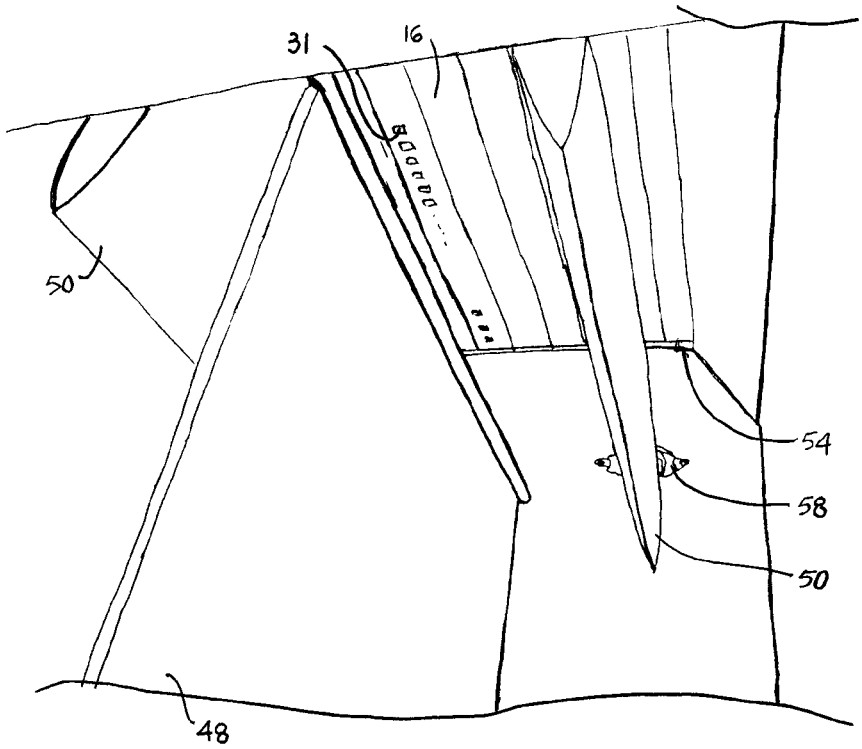
FIG. 4 is a perspective view from below of the flow modulation vanes in the top of the blower duct of the air separator of FIG. 1.

One version of an air separator embodying features of the invention is shown in FIGS. 1-3. The air separator 10 comprises a lower blower assembly 12 and an upper waste separation assembly 14 on opposite sides of a carryway portion 15 of a conveyor, such as a conveyor belt 16. The two assemblies are mounted in a frame 18 that also supports the conveyor. In this example, the conveyor belt 16 is trained around drive sprockets (not shown) on a drive shaft 20 and an idle shaft 21 and around idle rollers 22 in a lower return run. The belt is driven by a drive motor 24 and a gear box 25 coupled to the drive shaft 20. The belt travels up an inclined section 26 to the upper horizontal carryway 15. The belt is laden with product conveyed along the upper carryway in a conveying direction 30. The conveyor belt 16 is a foraminous belt with many openings 31 (FIG. 4) extending through the belt's thickness. The openings are large enough to allow fluids to drain through the belt and for air to pass upward through the belt into the product. Each opening is small enough to prevent products from falling through. Side rails 32 flank the belt on opposite sides to confine product to the belt.

As shown in FIGS. 1-4 and 6A-D, the lower blower assembly includes a centrifugal fan, or blower 34, driven by a motor 36 such as a variable-speed motor. The blower housing 38 has a screen 40 to cover the air intake 42. The blower 34 blows air out the blower housing into a vertical blower duct 44. The duct may optionally be divided into two parallel sub-ducts 46, 47 by an airflow divider 48 that extends across the width of the vertical blower duct.

A pair of elongated vanes 50, or paddles, are mounted between side walls 52, 53 of the blower duct near its top exit end 54. A shaft 56 runs the length of each vane 50 across the width of the blower duct 44. The ends of the shaft are mounted in roller bearings 58 in each side wall 52, 53. The shafts define axes of rotation 60, 61 (FIG. 5) for the vanes that are parallel to each other and perpendicular to the conveying direction 30. When the airflow divider is used, each vane is more or less aligned with one of the sub-ducts 46, 47. The vanes are counter-rotated back and forth to cyclically open and close the duct. When the vanes are open, the air flow is centered across the width of the duct away from the two laterally extending duct walls 62, 63.

One means for cyclically rotating the vanes includes a pair of meshed gear sectors 64, 65 mounted to the ends of the vane shafts 56, 56' and a crank arm 66 pivotally connected at one end to a pivot pin 68 on one of the gear sectors and to a cantilevered crank 70 at the other end. The crank is mounted to a shaft 72 extending from a gearbox 74. The crank is radially offset from the shaft to follow a circular orbit about the shaft's axis. A motor 76 is coupled to the gearbox to rotate the shaft. The pivot pin 68 extends outward of the gear sectors 64, 65 through a curved slot 78 in a gear cover 80. The orbital motion of the crank 70 causes the gear sector 65 to which it is attached to reciprocate rotationally back and forth about the shaft 56 and rotate the associated vane. The geared coupling with the other gear sector 64 causes the other vane to rotate in the opposite direction from the first vane. In other words, when one vane rotates clockwise, the other rotates counter-clockwise, and vice versa. The range of rotation of the vanes can be adjusted by changing the length of the arm 66. As shown in this example, the arm is made length-adjustable by a turnbuckle 82 forming a segment of the arm. A linear actuator could be used to replace the manually operated turnbuckle with an automatically operated length-adjustable segment of the arm. A sensor, such as an angle encoder 84, mounted on one or the other of the vane shafts can be used to provide a signal indicating the angular position of the vanes.

As shown in FIG. 3, the air blown through the foraminous conveyor belt uniformly across its width and through the conveyed product lifts lightweight waste material 86 into a waste conveyor duct 88, which forms a vertical tunnel. The lightweight waste is conducted mainly up a central region of the waste conveyor duct by the centered pulses of air provided by the counter-rotating vanes. The top of the lower duct has a short tapered portion 90 between the vanes 50 and the underside of the conveyor belt 16 to make the exit opening of the lower duct match the entrance opening to the waste conveyor duct 88. Opposite lateral walls 92, 93 of the waste conveyor duct taper inward to narrow the duct in the conveying direction with distance from the conveyor belt. The constricting cross section increases the air speed toward the top end 94 of the waste conveyor duct. An upper hood 96 of the waste separation assembly 14 has an airflow bifurcator 98 centered opposite the top end 94 of the waste conveyor duct to split the air flow and conduct the lightweight waste 86 in two directions 100, 101: one in the conveying direction, the other opposite to the conveying direction. Waste separation chambers 102, 103 on opposite sides of the airflow bifurcator collect the lightweight waste. The sides of the chambers are perforated with many small openings 99 to allow the air, and not the waste, to escape. The waste conveyor duct 88 has a textured surface 104, such as a quilted surface, to prevent moist waste from adhering. A tilted waste pan 106 in each waste separation chamber provides a slide along which the collected waste can slide into a trough 108 and out the chamber through a drain pipe. Fluid nozzles 110 (FIG. 1) direct water onto the tops of the pans 106 to wash the collected waste particles into the trough. The water is supplied via a pipe network 112.

Figure 6D:
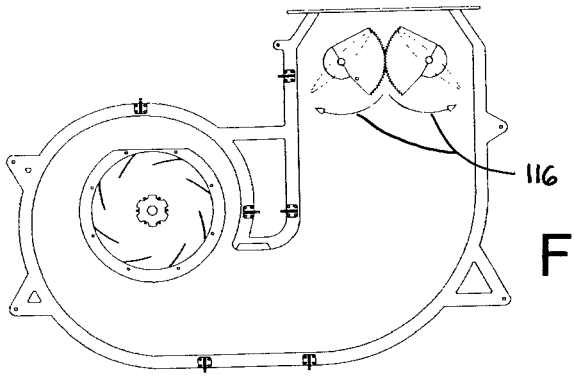
FIGS. 6A-6D are side elevation views of the blower duct showing the cyclic operation of the vanes of FIG. 4.
Figure 6C:
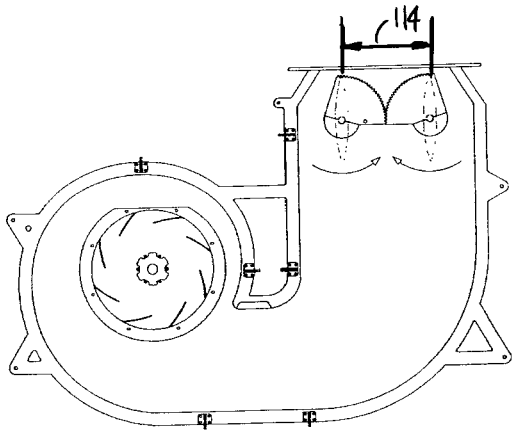
Figure 6B:
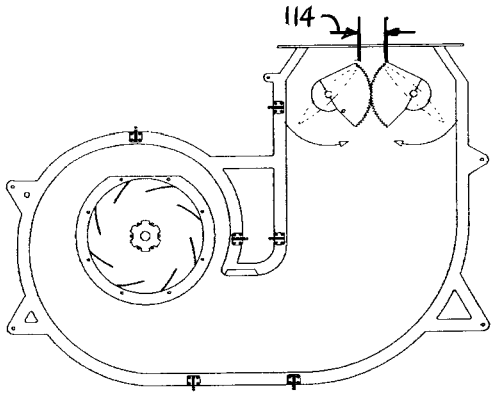
Figure 6A:
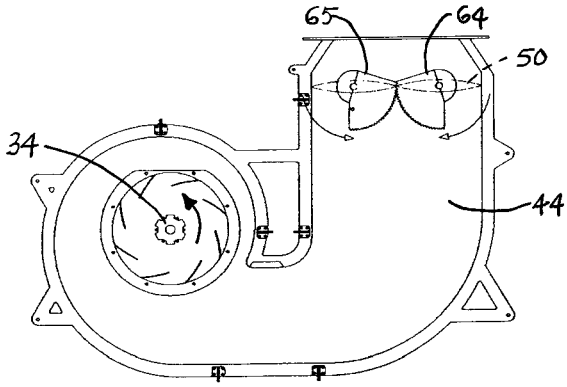

The cyclic operation of the vanes 50 is illustrated in FIGS. 6A-6D. In FIG. 6A, the vanes are shown in a closed position. The two vanes 50 are aligned linearly across the blower duct to block the air flow and build up air pressure below the vanes. When the vanes are closed, the air flow through the belt decreases to a minimum speed of zero. The gear sectors 64, 65 are at one end of their range of rotation. FIG. 6B shows the vanes 50 at an intermediate position on their way from the closed position to the fully open position. In this intermediate position, the central gap 114 between the vanes directs the air flow centrally through the duct. The sudden release of the high-pressure air through the vanes creates a blast of high-speed air along a central region of the duct across its full width. The air continues to flow at a high speed as the gear sectors 64, 65 counter-rotate to the opposite end of their range in the fully open position shown in FIG. 6C, in which the major axes of the cross sections of the vanes are parallel to each other and vertical. In the fully open position, the gap 114 is at its maximum length. At this midpoint in the cycle, the gear sectors start to counter-rotate in the opposite direction, as indicated by the change in sense of arrows 116 in FIG. 6D showing the vanes closing on their way back to the closed position of FIG. 6A to end the cycle and start another. As the vanes close, the air speed decreases from its maximum value. The cyclic opening and closing of the vanes establishes a cyclically pulsing air flow to lift lightweight waste from the conveyed product and blow it through the waste conveyor duct to the two waste separation chambers. Cycle frequencies of between about 60 cycles/minute and 200 cycles/minute have been found to work well with shrimp. Splitting the flow exiting the waste conveyor duct with the bifurcator decreases the maximum path length that any waste particle has to travel to the waste separation chambers. This allows a smaller and less noisy blower to be used. And the centralized air flow lessens the amount of waste that adheres to the walls of the waste conveyor duct.

Figure 5:
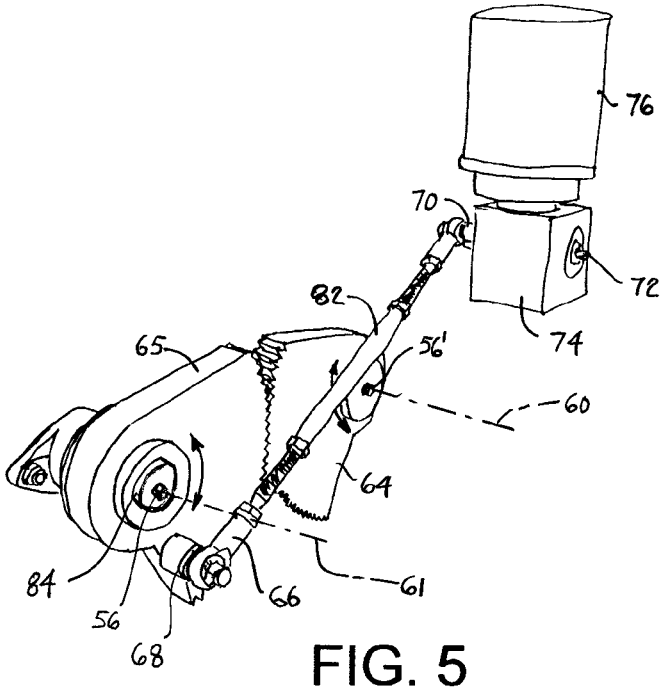
FIG. 5 is a perspective view of one version of a vane drive mechanism in the air separator of FIG. 1.
Figure 7:
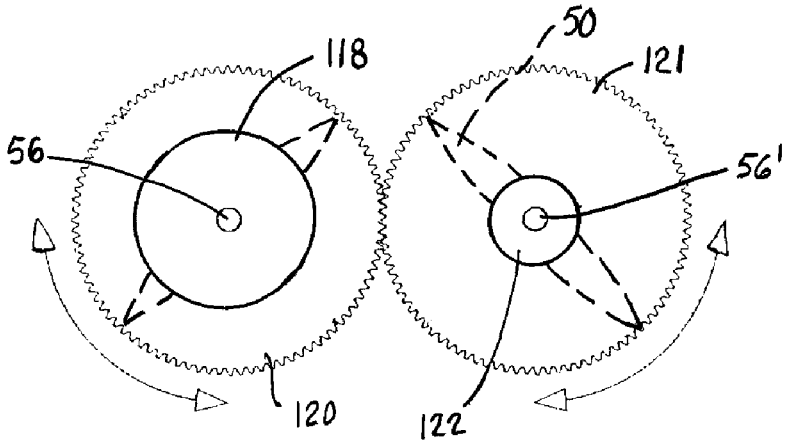
FIG. 7 is a side elevation view of another version of a vane drive mechanism using a variable speed motor drive for the vanes.

Another means for cyclically rotating the vanes is shown in FIG. 7. In this version, a bidirectional, variable-speed motor 118 drives a first gear wheel 120 meshed with a second gear wheel 121. Each of the gear wheels is mounted to one of the shafts 56, 56' of the vanes 50. In this way the two vanes can counter-rotate together back and forth between the open and closed positions. The 360° gear wheels also permit the vanes to counter-rotate continuously without the reversal required when the gear sectors 64, 65 of FIG. 5 are used. Of course, 360° gear wheels could replace the gear sectors in FIG. 5, and gear sectors could be used with the motor 118 in FIG. 7. A shaft encoder 122 can be mounted to the shaft of one of the vanes to provide angular-position feedback.

Figure 8:
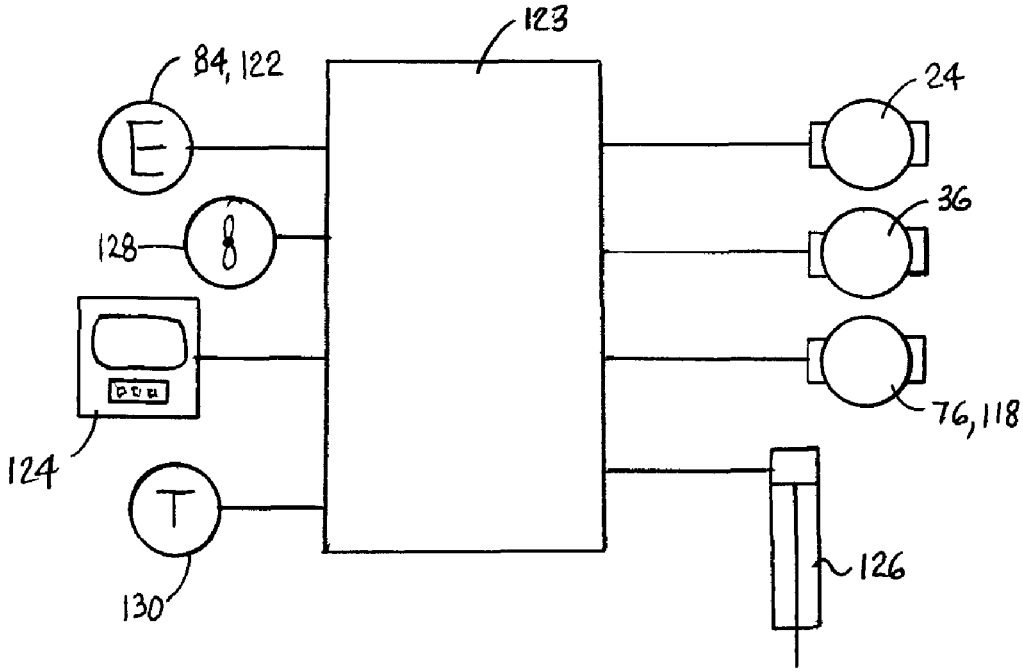
FIG. 8 is a block diagram of a control system for the air separator of FIG. 1.

FIG. 8 shows a control system for automatic control of the air separator. The control system includes a controller 123, such as a programmable logic controller or a laptop, desktop, or workstation computer. A user interface 124 to the controller allows an operator to control and maintain the operation of the air separator. Some of the operating variables the operator can set via the user interface include the speed of the conveyor, the range of rotation of the vanes, the speed or cycle time of the vanes, and the speed of the blower. Based on the operator's settings, the controller outputs signals to the conveyor drive motor 24 to set the speed of the conveyor, the blower motor 36 to control the air flow, the vane motor 76, 118 to control the speed or cycle time or frequency of the vanes and also the range of rotation of the vanes in the case of the motor 118 of FIG. 7, and the range of rotation of the vanes when the adjustable-link portion of the crank arm 66 of FIG. 5 is realized with a linear actuator 126 instead of a turnbuckle. The controller 123 may also receive sensor signals to provide closed-loop control of the air separator. Feedback signals from the shaft encoder 84, 122, an airflow sensor 128, such as an anemometer, and motor-speed sensors 130, such as tachometers, may be used to operate the air separator in a closed-loop system.

The air separator described is particularly useful in separating lightweight shrimp peelings, such as shell and head fragments, swimmerettes, and legs, from peeled shrimp meats. But it may also be used in the processing of nuts, grains, fruits and vegetables, and non-food products. Although the air separator has been described in detail by reference to a few versions, other versions are possible. So the claims are not meant to be limited to the details of the disclosed versions or applications.

What is claimed is:

1. An air separator for separating lightweight waste from product conveyed on a conveyor, the air separator comprising:

a first duct having an exit proximate the underside of a conveyor conveying product in a conveying direction;

a pair of vanes spanning the first duct; and means for cyclically rotating the vanes by counter-rotating the vanes back and forth on parallel axes between a closed position blocking air flow through the first duct and an open position forming between the vanes a centrally disposed gap across the first duct to direct a pulsating air flow centrally through the first duct and the conveyor to blow lightweight waste upward from the product.

2. An air separator as in claim 1 further comprising:

a waste conveyor duct disposed above the conveyor in alignment with the first duct to conduct the lightweight waste blown from product conveyed on the conveyor.

3. An air separator as in claim 2 wherein the waste conveyor duct includes a pair of opposite walls that taper inward to narrow the waste conveyor duct in the conveying direction with distance from the conveyor.

4. An air separator as in claim 2 further comprising an airflow bifurcator centered opposite a top end of the waste conveyor duct to split the air flow and conduct the lightweight waste in different first and second directions.

5. An air separator as in claim 4 further comprising first and second waste separation chambers on opposite sides of the airflow bifurcator to collect the lightweight waste conducted in the first and second directions and provide exits to the air flow.

6. An air separator as in claim 1 comprising a blower blowing air through the first duct and further comprising an airflow divider extending across the first duct between the blower and the vanes to divide the first duct into a pair of sub-ducts.

7. An air separator as in claim 6 wherein each of the sub-ducts is aligned with one of the vanes.

8. An air separator as in claim 1 wherein the means for cyclically rotating the vanes comprises:

a rotating crank;

a first gear coupled to one of the vanes;

a second gear coupled to the other of the vanes and meshed with the first gear;

an arm having a first end pivotally connected to the crank and a second end pivotally connected to the first gear;

wherein the crank and the arm reciprocate the first and second gears to counter-rotate the vanes back and forth between the open and closed positions.

9. An air separator as in claim 8 wherein the first and second gears are gear sectors.

10. An air separator as in claim 8 wherein the arm is length-adjustable to adjust the range of rotation of the vanes.

11. An air separator as in claim 1 further comprising a sensor sensing the angular position of the vanes.

12. An air separator as in claim 1 wherein the first duct includes a tapered portion between the vanes and the conveyor.

13. An air separator as in claim 1 comprising a pair of rotatable shafts extending across the first duct along the axes, wherein the vanes are mounted on the shafts.

14. An air separator as in claim 1 further comprising a controller controlling one or more of the conveyor speed, the speed of rotation of the vanes, the range of rotation of the vanes, and the air flow.

15. An air separator for separating lightweight waste from product conveyed on a foraminous conveyor belt, the air separator comprising:

a blower assembly disposed below the carryway of a foraminous conveyor belt conveying product in a conveying direction, the blower assembly including:

a blower;

a blower duct directing air from the blower upward through the foraminous conveyor belt;

a pair of vanes extending laterally across the width of the blower duct on laterally disposed axes of rotation perpendicular to the conveying direction;

means for cyclically rotating the vanes back and forth on the axes of rotation between a closed position blocking the blower duct and an open position directing air in the blower duct between the vanes to produce a pulsating air flow through the foraminous conveyor belt.

16. An air separator as in claim 15 further comprising:

a waste conveyor duct disposed above the carryway of the foraminous conveyor belt in alignment with the blower duct to conduct lightweight waste blown from product conveyed on the foraminous conveyor belt by the pulsating air flow through the foraminous belt.

17. An air separator as in claim 16 wherein the waste conveyor duct includes opposite laterally disposed walls that taper inward to narrow the waste conveyor duct in the conveying direction with distance from the foraminous conveyor belt.

18. An air separator as in claim 16 further comprising an airflow bifurcator centered opposite a top end of the waste conveyor duct to split the air flow and conduct lightweight waste in different first and second directions.

19. An air separator as in claim 15 wherein the blower assembly further includes an airflow divider extending laterally across the blower duct between the blower and the vanes to divide the blower duct into a pair of sub-ducts.

20. An air separator as in claim 15 wherein the means for cyclically rotating the vanes comprises:

a rotating crank;

a first gear coupled to one of the vanes;

a second gear coupled to the other of the vanes and meshed with the first gear;

an arm having a first end pivotally connected to the crank and a second end pivotally connected to the first gear;

wherein the crank and the arm reciprocate the first and second gears to cyclically rotate the vanes back and forth between the open and closed positions.

21. An air separator as in claim 20 wherein the first and second gears are gear sectors.

22. An air separator as in claim 20 wherein the arm is length-adjustable to adjust the range of rotation of the vanes.

23. An air separator as in claim 15 wherein the vanes are aligned horizontally across the blower duct in the closed position to block air flow and are rotated simultaneously in opposite directions on the axes of rotation to the open position to create an increasing central gap between the vanes to direct the air flow centrally through the blower duct and through the foraminous conveyor belt.

24. A method for separating lightweight waste from product conveyed on a foraminous conveyor belt, comprising:

(a) directing an air flow through a duct and the underside of a foraminous conveyor belt conveying product in a conveying direction;

(b) confining the majority of the air flow to a central portion of the duct uniformly across the width of the foraminous conveyor belt;

(c) cyclically pulsing the air flow between a maximum speed and a minimum speed to blow lightweight waste upward away from the product conveyed on the foraminous conveyor belt by cyclically counter-rotating a pair of vanes back and forth in the duct along parallel axes between a closed position blocking the duct to reduce the air flow to the minimum speed and an open position directing the majority of the air flow at the maximum speed through a central portion of the duct between the open vanes.

25. The method of claim 24 further comprising:

adjusting the maximum and minimum speeds of the air flow.

26. The method of claim 24 further comprising:

conducting lightweight waste upward from the product conveyed on the foraminous conveyor belt and then outward in a first direction parallel the conveyance direction and in a second direction opposite to the conveyance direction.

* * * * *